United States Patent [19]

Tamagawa et al.

[11] Patent Number: 4,749,678

[45] Date of Patent: Jun. 7, 1988

[54] HEAT-SENSITIVE RECORDING PAPER

[75] Inventors: Shigehisa Tamagawa; Tetsuro Fuchizawa, both of Shizuoka, Japan

[73] Assignee: Fuji Photo Film Co., Ltd., Kanagawa, Japan

[21] Appl. No.: 824,919

[22] Filed: Feb. 3, 1986

[30] Foreign Application Priority Data

Feb. 1, 1985 [JP] Japan ..... 60-18447

[51] Int. Cl.[4] ..... B41M 5/18

[52] U.S. Cl. ..... 503/200; 427/152; 428/537.5; 503/226

[58] Field of Search ..... 346/200, 226; 427/150, 427/151, 152; 428/195, 211, 341, 342, 537.5, 913, 914; 503/200, 226

[56] References Cited

U.S. PATENT DOCUMENTS 4,490,732 12/1984 Maekawa et al. ..... 346/226

FOREIGN PATENT DOCUMENTS 0038293 4/1981 Japan ..... 346/200

2032126A 4/1980 United Kingdom ..... 346/200

*Primary Examiner*—Bruce H. Hess

*Attorney, Agent, or Firm*—Sughrue, Mion, Zinn, Macpeak & Seas

[57] ABSTRACT

A heat-sensitive recording paper is described, comprising a paper support having formed thereon a heat-sensitive color forming layer, wherein said paper support is subjected to surface sizing with a synthetic sizing agent so as to have a Cobb-water absorption degree as defined by JIS-P-8140 of 25 g/m$^2$ or less.

10 Claims, No Drawings

HEAT-SENSITIVE RECORDING PAPER

FIELD OF THE INVENTION

This invention relates to a heat-sensitive recording paper for conducting recording by a thermal head or a thermal pen. More particularly, the invention relates to a heat-sensitive recording paper which causes neither sticking between a thermal head and the heat-sensitive color forming layer thereof nor piling on a thermal head and gives clear and high-density recording with good reproducibility of dot even in high-speed recording.

BACKGROUND OF THE INVENTION

Recently, facsimile equipment, printers, etc., have become remarkably developed, and a heat-sensitive recording system comprising a combination of, for example, a heat-sensitive recording paper having a heat-sensitive color forming layer containing a colorless dye such as crystal violet lactone and a phenol compound and a thermal head as described, for instance, in Japanese Patent Publication No. 14039/70 (corresponding to British Patent Publication No. 1,135,540 A), etc., is widely employed for such apparatus.

The heat-sensitive recording system has many advantages that the recording paper is of primary coloring, the system does not require liquid development, the recording apparatus can be simplified, the costs for recording papers, recording apparatus, etc., are low, recording can be performed in a non-impact manner without generating noise, etc., and hence this system has gained a steadfast position as a low-speed recording system. However, a significant disadvantage of the heat-sensitive recording system is that the recording speed is lower than those of other recording systems such as electrostatic recording, and hence the recording system has not yet been employed in high-speed recording.

The main reason that the aforesaid heat-sensitive recording system has not been applicable for high-speed recording in heat-sensitive recording is that the heat conduction between a thermal head and a heat-sensitive recording paper which is brought into contact with the thermal head is insufficient, whereby a sufficient recording density is not obtained.

A thermal head composed of an assembly of dot-form electron resistance heating elements generates heat by recording signals to melt and color a heat-sensitive color forming layer in contact with the thermal head. In this system, for obtaining clear and high-density recording, it is required that the dot reproducibility is good, that is, it is required that a thermal head is brought into contact with a heat-sensitive color forming layer as closely as possible in order to efficiently conduct heat transfer and form completely colored dots corresponding to the form of the dot heating elements of the thermal head at high-speed. However, at present, only a few percent of the amount of heat generated at the thermal head is transferred to the heat-sensitive color forming layer, and hence the heat transfer efficiency is very low.

Various methods for improving the smoothness of a heat-sensitive color forming layer for bringing a heat-sensitive color forming layer into contact with a thermal head as closely as possible have been proposed.

For example, Japanese Patent Publication No. 20142/77 describes that the surface of a heat-sensitive color forming layer is treated to provide a surface smoothness of 200 to 1,000 sec. in Beck smoothness.

Japanese Patent Application (OPI) No. 115255/79 (The term "OPI" as herein used refers to a "published unexamined Japanese patent application".) describes that the heat-sensitive color forming layer having a surface smoothness of from 200 to 1,000 sec. in Beck smoothness can respond to a heat pulse of as short as about 5 or 6 milli-seconds and for performing high-speed recording of shorter than 1 milli-second, it is necessary that the surface of a heat-sensitive color forming layer is treated to provide a surface smoothness of higher than 1,100 sec. in Beck smoothness. However, if the surface of a heat-sensitive coloring layer is smoothened to higher than 1,100 sec. in Beck smoothness, colored fog is formed due to pressure. The formation of colored fog is prevented by previously improving the smoothness of the surface of a base paper for a heat-sensitive recording paper to higher than 500 sec. in Beck smoothness. Furthermore, Japanese Patent Application (OPI) No. 156086/78 describes that the surface roughness Ra of the surface of a heat-sensitive color forming layer is reduced to lower than 1.2 $\mu$m, and the glossiness thereof is reduced to lower than 25% of its original value.

In the above-described conventional techniques for improving the smoothness of heat-sensitive color forming layers of heat-sensitive recording papers, the smoothness of the heat-sensitive color forming layers is improved by a calender treatment simply using a super calender, a machine calender, a gloss calender, etc. The calender treatment is applied to a base paper only or to a base paper and the heat-sensitive paper using the base paper, or to a heat-sensitive paper only. In this case, however, in the heat-sensitive paper the smoothness of the surface of which is improved by the calender treatment, with the improvement of recording density by the increase of the smoothness, the occurrence of sticking, piling, etc., of the heat-sensitive paper on a thermal head is increased, and hence the smoothness thereof is, in reality, controlled to a proper level to properly balance the recording density with the sticking or piling tendencies. Such conventional techniques cannot practically be applied for high-speed recording in point of recording density or recording stability to reduce the sticking and piling regardless of the selection of the smoothness level.

Sticking is a phenomenon in which a heat-sensitive color forming layer of the heat-sensitive recording paper sticks to a thermal head during recording to generate peeling sound and/or reduce the dot reproducibility, and piling is a phenomenon in which the heat melt of a heat-sensitive color forming layer is piled on a thermal head to reduce recording density and dot reproducibility. Both of these phenomena disturb stable recording in heat-sensitive recording systems.

Also, another demerit of the calender treatment for a heat-sensitive paper is that the heat-sensitive paper forms colored fog due to pressure, to thereby cause a high density in the background portions of the heat-sensitive recording paper. On the other hand, at present, there is a limit about a calender treatment onto a base paper owing to the formation of cockle, wrinkless, etc., caused by uneven basis weight of the heat-sensitive recording layer.

As described above, there remain limits on the smoothening of a heat-sensitive color forming layer and the increase of recording density that is possible by a calender treatment. Thus, a sufficiently satisfactory heat-sensitive recording paper for high-speed recording has not yet been obtained by the application of a calender treatment.

SUMMARY OF THE INVENTION

The object of this invention is to provide a heat-sensitive recording paper capable of overcoming the above-described disadvantages of the conventional techniques, and thus providing a heat-sensitive recording paper giving good dot reproducibility and high recording density.

As a result of extensive investigations for overcoming the above-described disadvantages, the inventors have discovered that the above-described object of this invention can be attained by applying surface sizing of a synthetic sizing agent onto a paper support for a heat-sensitive recording paper in order to prevent the occurrence of a reduction in the surface smoothness during coating of the heat-sensitive coating composition on the paper support. That is, it has been discovered that a heat-sensitive recording paper giving good dot reproducibility and high recording density is obtained by forming a heat-sensitive color forming on a paper support by which is subjected to surface sizing with a synthetic sizing agent so as to have a Cobb-water absorption degree as defined by JIS-P-8140 (Cobb-test: a test method for water adsorptiveness of paper) of 25 g/m$^2$ or less, preferably 20 to 10 g/m$^2$.

DESCRIPTION OF PREFERRED EMBODIMENTS

The invention is explained below in more detail.

A paper support which is used for the heat-sensitive recording paper of this invention is subjected to surface sizing by a synthetic sizing agent. Examples of the synthetic sizing agent are a styrene-maleic anhydride copolymer, polyacrylamide, polyamidopolyurea, polyamidopolyamine epichlorohydrin, an alkylketene dimer, epoxylated fatty acid amide, polyurethane, etc., synthetic sizing agent composed of a reaction product of a fatty acid having at least 10 carbon atoms is preferred. That is, practically, an alkylketene dimer obtained by polymerizing an alkylketene which is a fatty acid reaction product, an epoxylated fatty acid amide obtained by the addition of epichlorohydrin to a reaction product of a fatty acid and a polyamine, and polyurethane of a reaction product of an aliphatic dihydroxyl compound and polyisocyanate are preferable used as the synthetic sizing agent in this invention. In these compounds, the epoxylated fatty acid amide obtained by the addition of epichlorohydrin to a reaction product of a fatty acid and a polyamine is particularly preferred. The preferred examples of the above polyamine include polyalkylene polyamine, more preferably a compound having two or three methylene groups between the amino groups. For example, the preferred examples thereof include diethylenetriamine, triethylenetetramine, tetraethylenepentamine, pentaethylenehexamine, dipropylenetriamine, tripropylenetetramine, aminoethyl ethanolamine, etc. The preferred examples of the above fatty acid include a compound having carbon atoms of 12 to 20, more preferably a stearic acid.

It is industrially advantageous to coat the synthetic sizing agent by a sizing bath, a sizing press, a gate roll coater, etc. The synthetic sizing agent may be also coated by an air knife coater, a bar coater, etc., in machine coating. The coating amount of the sizing agent is preferably from 0.01 to 2.0 g/m$^2$, and more preferably from 0.05 to 0.5 g/m$^2$.

In addition, the synthetic sizing agent can be, as a matter of course, used individually, but may be used, if necessary, together with other water-soluble polymer, a filler, etc.

The paper support for use in this invention is preferably produced using mainly a wood pulp, but may be produced using a mixture of a wood pulp and synthetic fibers or a synthetic pulp. As a wood pulp, a needle-leaved tree pulp or a broadleaf tree pulp can be used but the use of a broadleaf tree pulp of short fibers capable of easily providing a smooth surface is preferred. The freeness of the pulp for use in this invention is preferably from 200 to 500 c.c. (C.S.F., Canadian Standard Freeness), and more preferably from 300 to 400 c.c.

Also, the pulp composition for making the paper support in this invention may contain a sizing agent such as rosin, paraffin wax, a higher fatty acid salt, an alkenyl succinate, a fatty acid anhydride, an alkylketene dimer, etc.; a paper strength increasing agent such as polyacrylamide, starch, polyvinyl alcohol (PVA), a melamine-formaldehyde condensation product, etc.; a softening agent such as a reaction product of a maleic anhydride copolymer and polyalkylenepolyamine, a quaternary ammonium salt of a higher fatty acid, etc.; a filler such as calcium carbonate, talc, clay, kaolin, titanium oxide, urea resin fine particles, etc.; a fixing agent such as aluminum sulfate, polyamidopolyamine epichlorohydrin, etc. The pulp composition may further, if desired, contain a dye or a fluorescent dye.

A heat-sensitive coating composition for use in this invention is explained below.

A color former and a developer each is separately dispersed in each aqueous solution of a water-soluble polymer using a means such as a ball mill, etc. For finely dispersing the color former or the developer, for example, by a ball mill, balls having different particle sizes are used in a proper mixing ratio and each mixture is dispersed thereby for a sufficient period of time. Also, the use of a model sand mill (Dyno mill), etc., is effective for the above-described purpose.

The dispersion of the color former and the dispersion of the developer thus obtained are mixed with each other and then an inorganic pigment, a wax, a higher fatty acid amide, a metal soap, and, if desired, an ultraviolet absorbent, an antioxidant, a latex series binder, etc., are added to the mixture to provide the heat-sensitive coating composition. These additives may be added to the above-described aqueous dispersions at dispersing the color former or the developer.

The heat-sensitive coating composition is coated on a paper support at a color former coverage of from 0.2 g/m$^2$ to 1.0 g/m$^2$.

Color formers which are used for general pressure-sensitive recording papers, heat-sensitive recording papers, etc., can be used as the color former in this invention without any particular restriction.

Specific examples of color formers include (1) triarylmethane series compounds such as 3,3-bis(p-dimethylaminophenyl)-6-dimethylaminophthalide (i.e., Crystal Violet lactone), 3-(p-dimethylaminophenyl)-3-(1,2-dimethylindol-3-yl)phthalide, 3-(p-dimethylaminophenyl)-3-(2-phenylindol-3-yl)phthalide, 3,3-bis-(p-ethylcarbazol-3-yl)-3-dimethylaminophthalide, 3,3-bis-(2-phenylindol-3-yl)-5-dimethylaminophthalide, etc.; (2) diphenylmethane series compounds such as 4,4-bis-dimethylaminobenzhydrinbenzyl ether, N-halophenyl leucoauramine, N-2,4,5-trichlorophenyl leucoauramine, etc.; (3) xanthene series compounds such as Rhodamine B-anilinolactam, 3-diethylamino-7-dibenzylaminofluoran, 3-diethylamino-7-butylaminofluoran, 3-diethylamino-7-(2-chloroanilino)fluoran, 3-diethylamino-6-methyl-7-anilinofluoran, 3-piperidino-6-methyl-7-anilinofluoran, 3-ethyl-triamino-6-methyl-7-anilinofluoran, 3-cyclohexyl-methylamino-6-methyl-7-anilinofluoran, 3-diethylamino-6-chloro-7-(β-ethoxyethyl) aminofluoran, 3-diethylamino-6-chloro-7-(γ-chloropropyl) aminofluoran, 3-diethylamino-6-chloro-7-anilinofluoran, 3-N-cyclohexyl-N-methylamino-6-methyl-7-anilinofluoran, 3-diethylamino-7-phenylfluoran, etc.; (4) thiadine series compounds such as benzoyl leucomethylene blue, p-nitrobenzoyl leucomethylene blue, etc.; and (5) spiro series compounds such as 3-methyl-spiro-dinaphthopyran, 3-ethyl-spiro-dinaphthopyran, 3-benzyl-spiro-dinaphthopyran, 3-methylnaphtho-(3-methoxybenzo)spiropyran, etc. They can be used solely or as a mixture thereof and are selected according to the intended use and the desired characteristics.

As the developer for use in this invention, phenol derivatives and aromatic carboxylic acid derivatives are preferably used, and bisphenols are particularly preferred. Specific examples of phenols include p-octylphenol, p-tert-butylphenol, p-phenylphenol, 2,2-bis (p-hydroxy)propane, 1,1-bis(p-hydroxyphenyl)pentane, 1,1-bis(p-hydroxyphenyl)hexane, 2,2-bis(p-hydroxyphenyl)-hexane, 1,1-bis(p-hydroxyphenyl)-2-ethyl-hexane, 2,2-bis (4-hydroxy-3,5-dichlorophenyl)propane, etc.

Also, specific examples of the aromatic carboxylic acid derivatives include p-hydroxybenzoic acid, propyl p-hydroxybenzoate, butyl p-hydroxybenzoate, benzyl p-hydroxybenzoate, 3,5-di-α-methylbenzylsalicylic acid, or polyvalent metal salts of said carboxylic acids, etc. The zinc salts thereof are preferred.

It is preferred that the developer is added to the above-described aqueous solution of a water-soluble polymer or binder as an eutectic mixture with a low melting heat-meltable material or as a state that a low-melting compound is fused to the surfaces of the developer particles for melting the developer and causing a coloring reaction at a desired temperature.

Examples of waxes which can be used for the heat-sensitive recording papers of this invention include paraffin wax, carnauba wax, microcrystalline wax, polyethylene wax, and higher fatty acid amides such as stearic acid amide, ethylenebis-stearoamide, higher fatty acid esters, etc.

Examples of metal soap which can be used in this invention include polyvalent metal salts of higher fatty acids, such as zinc stearate, aluminum stearate, calcium stearate, zinc oleate, etc.

Examples of inorganic pigments which can be used in this invention include kaolin, baked kaolin, talc, roselite, diatomaceous earth, calcium carbonate, aluminum hydroxide, magnesium hydroxide, magnesium carbonate, titanium oxide, barium carbonate, etc.

It is preferred that the oil absorptiveness of the inorganic pigment is 60 ml/100 g or more and the average particle size thereof is 5 μm or less. It is preferred that an oil absorptive inorganic pigment exists in the heat-sensitive recording layer in a dry weight of from 5 to 50% by weight, and particularly preferably from 10 to 40% by weight.

The above-described components are coated on the paper support having a Cobb-water absorption degree of 25 g/m$^2$ or less by the application of surface sizing as a dispersion in a binder.

As the binder, a water-soluble binder is generally used. Specific examples of the binder are polyvinyl alcohol, hydroxyethyl cellulose, hydroxypropyl cellulose, an ethylene-maleic anhydride copolymer, a styrene-maleic anhydride copolymer, an isobutylene-maleic anhydride copolymer, polyacrylic acid, starch derivatives, casein, gelatin, etc.

Also, for imparting water resistance to the binder, a water resistance imparting agent (e.g., a gelling agent, a crosslinking agent, etc.) may be added to the binder or an emulsion of a hydrophobic polymer, such as a styrene-butadiene rubber latex, an acrylic resin emulsion, etc., may be added thereto.

The binder is incorporated in the heat-sensitive recording layer in a dry weight of from 10 to 30% by weight. Furthermore, if necessary, various assistants such as a defoaming agent, a fluorescent dye, a coloring dye, etc., may be properly added to the coating composition.

The heat-sensitive coating composition described above can be coated using a conventional coating method such as a blade coating method, an air knife coating method, a gravure coating method, a roll coating method, a spray coating method, a dip coating method, a bar coating method, an extrusion coating method, etc.

There is no particular restriction on the coating amount of the heat-sensitive coating composition for forming the heat-sensitive recording layer, but the amount is generally in the range of from 3 to 15 g/m$^2$, and preferably from 4 to 10 g/m$^2$ by dry weight.

The following example is intended to illustrate the present invention, but not to limit it in any way. Unless otherwise indicated in the following examples, all parts and percents are by weight.

EXAMPLE

After beating 100 parts of LBKP ((Laubholz) Bleeched Kraft Pulp) to a Canadian freeness of 350 c.c., 5.0 parts of talc, 0.3 part of rosin, and 1.0 part of aluminum sulfate were added to the pulp, and a paper was manufactured using the pulp composition obtained by means of a Fourdrinier paper machine. In addition, a surface sizing agent was coated on the surface of the paper as shown in Table 1 shown below by means of a sizing press of the paper manufacturing machine, and thus paper supports each having a base weight of 50 g/m$^2$ and a thickness of 60 μm were obtained. Thus 4 kinds of samples of this invention and 4 kinds of comparison samples were prepared.

Each of the samples thus prepared was coated with the heat-sensitive coating composition shown below to provide each heat-sensitive recording paper. Then, after performing heat recording using each of the heat-sensitive recording papers, the recorded densities were measured and the results obtained are shown in Table 2 below.

In addition, the production method of the heat-sensitive coating composition used above, the coating method thereof, and the measurement method of the recording density are shown below.

PRODUCTION METHOD OF HEAT-SENSITIVE COATING COMPOSITION

In an aqueous solution of 10% polyvinyl alcohol (saponification degree 98%, polymerization degree 500)

was dispersed 20 kg of Crystal Violet lactone for 24 hours in a 300 liter ball mill. Also, 20 kg of 2,2-bis(4-hydroxyphenyl)propane was dispersed in an aqueous solution of 10% polyvinyl alcohol for 24 hours in a 300 liter ball mill. Both of the dispersions thus prepared were mixed with each other so that the weight ratio of Crystal Violet lactone to 2,2-bis(4-hydroxyphenyl)propane became 1/5 and then 5 kg of precipitated calcium carbonate was sufficiently dispersed in 20 kg of the mixture to provide the heat-sensitive coating composition.

COATING METHOD OF HEAT-SENSITIVE COATING COMPOSITION

The coating composition was coated on one surface of the base paper by means of an air knife coater at 6 g/m$^2$ as solid component, dried in a dryer by a hot air blast at 50° C., and passed through a machine calender.

MEASUREMENT METHOD OF RECORDING DENSITY

Solid black-like coloring was performed at a recording speed of 2 milli-seconds per dot, a recording density of 5 dots/mm in the main scanning direction and 6 dots/mm in a side scanning direction, and a thermal head energy of 50 milli-joules/mm$^2$. The measurement of the recording density was performed by measuring the reflection density at 610 nm.

TABLE 1

| Sample | Surface Sizing Agent and Coating Amount | Cobb-Water Absorption Degree |
|---|---|---|
| Sample 1 | Alkyl Ketene Dimer* (0.10 g/m$^2$) | 20 g/m$^2$ |
| Sample 2 | Epoxylated Fatty Acid Amide** (0.10 g/m$^2$) | 24 g/m$^2$ |
| Sample 3 | Polyurethane*** (0.10 g/m$^2$) | 19 g/m$^2$ |
| Sample 4 | Polyurethane/Carboxymethyl Cellulose (0.15/0.15 g/m$^2$) | 18 g/m$^2$ |
| Comparison Example 1 | None | 36 g/m$^2$ |
| Comparison Example 2 | Starch (0.10 g/m$^2$) | 37 g/m$^2$ |
| Comparison Example 3 | Starch (1.0 g/m$^2$) | 40 g/m$^2$ |
| Comparison Example 4 | Polyvinyl Alcohol (1.0 g/m$^2$) | 39 g/m$^2$ |

*Polymer of stearylketene
**Epichlorohydrin addition product of the reaction product of stearic acid and a polyvalent amine
***Reaction product of glycerol monostearate and polyisocyanate

TABLE 2

| Sample | Recording Density | Reproducibility of Dot |
|---|---|---|
| Sample 1 | 1.08 | Good |
| Sample 2 | 1.06 | Good |
| Sample 3 | 1.12 | Good |
| Sample 4 | 1.15 | Excellent |
| Comparison Sample 1 | 0.89 | Possible |
| Comparison Sample 2 | 0.90 | " |
| Comparison Sample 3 | 0.78 | " |
| Comparison Sample 4 | 0.83 | " |

From the results shown in Table 2, it can be seen that the heat-sensitive recording papers (Samples 1 to 4) of this invention are excellent in recording density and dot reproducibility as compared to the comparison samples.

As described above, the heat-sensitive recording paper of this invention using the paper support having the Cobb-water absorption degree defined by JIS-P-8140 of 25 g/m$^2$ or less by surface sizing with a synthetic sizing agent gives an increased contact area between the heat-sensitive color forming layer thereof and a thermal head at heat recording and thus gives high recording density and good dot reproducibility.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper comprising a paper support having formed thereon a heat-sensitive color forming layer, wherein said paper support is subjected to surface sizing with a synthetic sizing agent so as to have a Cobb-water absorption degree as defined by JIS-P-8140 of 25 g/m$^2$ or less.

2. A heat-sensitive recording paper as in claim 1, wherein the surface sizing is conducted by coating the synthetic sizing agent on the paper support.

3. A heat-sensitive recording paper as in claim 2, wherein the synthetic sizing agent is a reaction product of a fatty acid having at least 10 carbon atoms.

4. A heat-sensitive recording paper as in claim 3, wherein the synthetic sizing agent is an alkylketene dimer obtained by polymerizing an alkylketene which is a fatty acid reaction product, an epoxylated fatty acid amide obtained by the addition of epichlorohydrin to a reaction product of a fatty acid and a polyamine, or polyurethane of a reaction product of an aliphatic dihydroxyl compound and polyisocyanate.

5. A heat-sensitive recording paper as in claim 4, wherein the coating amount of the sizing agent is from 0.01 to 2.0 g/m$^2$.

6. A heat-sensitive recording paper as in claim 4, wherein the coating amount of the sizing agent is from 0.05 to 0.5 g/m$^2$.

7. A heat-sensitive recording paper as in claim 3, wherein the coating amount of the sizing agent is from 0.01 to 2.0 g/m$^2$.

8. A heat-sensitive recording paper as in claim 3, wherein the coating amount of the sizing agent is from 0.05 to 0.5 g/m$^2$.

9. A heat-sensitive recording paper as in claim 2, wherein the coating amount of the sizing agent is from 0.01 to 2.0 g/m$^2$.

10. A heat-sensitive recording paper as in claim 2, wherein the coating amount of the sizing agent is from 0.05 to 0.5 g/m$^2$.

* * * * *